US006197083B1

(12) United States Patent
Rolander et al.

(10) Patent No.: US 6,197,083 B1
(45) Date of Patent: Mar. 6, 2001

(54) METHOD FOR PRODUCING TITANIUM-BASED CARBONITRIDE ALLOYS FREE FROM BINDER PHASE SURFACE LAYER

(75) Inventors: Ulf Rolander, Stockholm; Gerold Weinl, Älvsjö, both of (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/112,453

(22) Filed: Jul. 9, 1998

(30) Foreign Application Priority Data

Jul. 10, 1997 (SE) ..... 9702695

(51) Int. Cl.[7] ..... C22C 29/04; B22F 3/12

(52) U.S. Cl. ..... 75/238; 419/16; 419/47; 419/56; 419/57

(58) Field of Search ..... 419/16, 47, 56, 419/57; 75/238

(56) References Cited

U.S. PATENT DOCUMENTS 4,225,344 * 9/1980 Fujimori et al. .
4,973,355 11/1990 Takahashi et al. .
5,856,032 * 1/1999 Daub et al. ..... 428/697

* cited by examiner

*Primary Examiner*—Daniel J. Jenkins
(74) *Attorney, Agent, or Firm*—Burns, Doane, Swecker & Mathis, L.L.P.

(57) ABSTRACT

The present invention relates to a method for obtaining a sintered body of carbonitride alloy with titanium as main component which does not have a binder phase layer on the surface after sintering. This is obtained by performing the liquid phase sintering step of the process at 1–80 mbar of CO gas in the sintering atmosphere.

13 Claims, 1 Drawing Sheet

METHOD FOR PRODUCING TITANIUM-BASED CARBONITRIDE ALLOYS FREE FROM BINDER PHASE SURFACE LAYER

BACKGROUND OF THE INVENTION

The present invention relates to a method for obtaining a sintered body of carbonitride alloy with titanium as the main component and which does not have a binder phase layer on the surface after sintering. This has been achieved by processing the material in a specific way to obtain poor wetting of the binder phase on the surface, essentially without depth effect.

Titanium-based carbonitride alloys, so-called cermets, are well established as insert material in the metal cutting industry and are especially used for finishing. They consist of carbonitride hard constituents embedded in a metallic binder phase.

In addition to titanium, group VIa elements, normally both molybdenum and tungsten and sometimes chromium, are added to facilitate wetting between binder and hard constituents and to strengthen the binder by means of solution hardening. Group IVa and/or Va elements, e.g., Zr, Hf, V, Nb and Ta, are also added in all commercial alloys available today, usually as carbides, nitrides and/or carbonitrides. The grain size of the hard constituents is usually <2 μm. The binder phase is normally a solid solution of mainly both cobalt and nickel. The amount of binder phase is generally 3–25 wt %. Furthermore, other elements are sometimes used, e.g., aluminum, which are said to harden the binder phase and/or improve the wetting between hard constituents and binder phase. Of course commercially available raw material powders also contain inevitable impurities. The most important impurity is oxygen, due to its high affinity to titanium. A normal impurity level for oxygen has historically been <0.3 wt %. Recently, due to improved production methods for titanium-based raw materials, this level has been possible to decrease to <0.2 wt %, especially for grades with low nitrogen content. Very high oxygen levels are generally avoided since this may cause formation of CO gas after pore closure, which in turn leads to excessive porosity.

Common for all cermet inserts is that they are produced by the powder metallurgical methods of milling powders of the hard constituents and binder phase, pressing to form bodies of desired shape and finally, liquid phase sintering the pressed bodies. During sintering, the bodies are heated above the eutectic temperature for the composition to form a liquid binder phase. Provided that good wetting is obtained between the liquid and the solid hard phase grains, strong capillary forces are obtained. The action of these forces is to shrink the porous body essentially isotropically, eliminating porosity. The linear shrinkage is typically 15–30%.

After such sintering, the cermet inserts are covered with a thin, continuous binder phase layer on the surface, typically 1–2 μm thick. This is a natural consequence of the good wetting. The presence of binder phase on the surface gives the inserts a nice metallic luster but is not desirable for at least three reasons:

1. For mass balance reasons, a shallow binder phase depletion is obtained just below the surface, adversely influencing the toughness of the material. Both the magnitude and the width of this depletion are difficult to control.
2. During the initial stages of cutting, before the binder phase layer has worn off, there is a significant risk that the chip from the work piece will be welded to the binder phase layer close to the cutting edge. Subsequently, when the chip is torn away, the cutting edge is damaged.
3. If the insert is to be coated with a thin wear resistant coating, the binder phase on the surface will decrease adhesion and quality of the coating.

Methods available today to remove the binder phase surface layer include chemical etching, grinding, blasting or brushing. All these methods represent expensive extra production steps and also have other disadvantages, e.g., preferential material removal, difficult process control and risk for surface corrosion.

OBJECTS AND SUMMARY OF THE INVENTION

It is an object of this invention to avoid or alleviate the problems of the prior art.

It is further an object of the present invention to provide a method for eliminating the formation of a binder phase surface layer on titanium-based carbonitride alloys during sintering.

In one aspect of the invention there is provided a liquid phase sintering method for producing titanium-based carbonitride alloys, the improvement comprising conducting the liquid phase sintering steps in the presence of a partial pressure of 1–80 mbar, preferably 1–10 mbar, most preferably 1–5 mbar, of CO gas in the sintering atmosphere.

In another aspect of the invention there is provided a method for producing titanium-based carbonitride alloys comprising milling powders of the hard constituents and binder phase, pressing the milled powders to form bodies of desired shape and liquid phase sintering the pressed bodies in the presence of 1–80 mbar, preferably 1–10 mbar, most preferably 1–5 mbar, of CO gas.

In yet another aspect of the invention there is provided a titanium-based carbonitride alloy free from a continuous binder phase surface layer in the as sintered condition.

DETAILED DESCRIPTION OF THE PREFERRED EMBODIMENTS OF THE INVENTION

Figure 1:
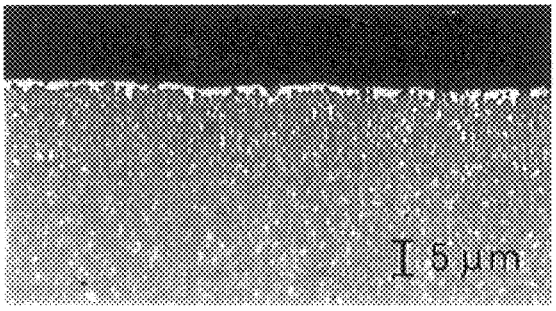
FIGS. 1, 3 and 5 show in 1000× cross-sections of cermet inserts sintered according to prior art and FIGS. 2, 4 and 6 sintered according to the present invention.

It has surprisingly been found that by maintaining a small amount of carbon monoxide gas (CO) added to the conventional sintering atmosphere generally being an industrial vacuum, i.e., less than 1 mbar partial pressures of mainly CO, $H_2$, $CO_2$ possibly with intentional additions of 1–100 mbar noble gas, during the liquid phase sintering step of the sintering process, the binder phase surface layer can be completely eliminated. The surface obtained is smooth and the process has essentially no depth effect. The amount of CO needed depends on the interstitial balance of the alloy, i.e., the ratio of interstitial atoms (C and N) to carbonitride forming metal atoms. For alloys with low interstitial balance, i.e., a high metal content, close to the eta-phase limit, about 1 mbar of CO is needed to obtain the desired effect. However, since commercially interesting alloys typically have an interstitial balance well below the graphite limit, the preferred pressure range is 1–10 mbar CO gas. For alloys combining good toughness and resistance to plastic deformation, the preferred range is 1–5 mbar CO gas. For alloys with high interstitial balance, close to or above formation of free graphite, as much as 80 mbar may have to be added to obtain the effect. Although not generally necessary, it is preferable that the CO pressure is maintained for at least 10 minutes and until the binder phase in the surface region of the insert has been fully solidified in the cooling step of the sintering process (1300–1425° C. depending on the exact composition of the alloy). The reason for maintaining the gas pressure during part of the cooling process is that surface oxidation of carbonitride grains is a reversible process. If the gas pressure is removed prematurely, the surface oxygen will be removed and the liquid binder may have time to spread across the surface.

When examining the composition of the residual gas in a normal sintering furnace at temperatures above 1300° C., one finds that it consists mainly of CO and $H_2$ with small additions of $CO_2$. Due to this, it is not necessary to supply CO gas from an external source. An alternative technique is to close the vacuum valve between the vacuum pump and the furnace and simply allow the partial pressure of CO to build up because of degassing from the interior parts of the furnace. When the desired pressure is reached, it is then controlled by normal pressure regulation of the furnace to maintain an essentially constant level. The drawback of this technique is that a slightly higher level of the other gases must be tolerated. On the other hand, it is not necessary to equip the furnace with equipment for external handling of a toxic gas (CO).

The method appears to have very general application for cermet materials. It works well for Co-based binders as well as mixed Co+Ni-based binders, at least for Co/(Ni+Co) ratios above 50 at % and binder phase levels (Co+Ni) below 20 at %. Group Va metals may be added at least up to 6 at % and Group VIa metals at least up to 12 at %. The sintering temperature may be at least as high as 1470° C.

The surface of a cermet sintered according to the present invention is free of binder phase, smooth, without scratches from mechanical treatment or etching effects and has an even binder phase content towards the surface.

While it is preferable to optimize the CO pressure for each alloy composition in order to obtain the best possible surface, this is not essential. The effect of applying a CO pressure slightly higher than the optimum is that a less shiny material with a darker, greyish color is obtained. This is cosmetically less appealing but again, there is essentially no depth effect (less than 3 $\mu$m) and the dark color is easily removed, e.g., with a gentle blasting or brushing operation. This is much less expensive than removing a metallic binder phase layer. One reason for using a slightly excessive CO pressure than optimum, is that several cermet grades may be sintered simultaneously, where the CO pressure is adjusted to the grade requiring the highest pressure. The cost of the extra surface treatment may be compensated for by the possibility of adding more material in each sintering batch. The method involves sintering of cermet material sensitive to its local surrounding in a reactive gas atmosphere. It is therefore preferable to surround the material with surfaces which are inert to the atmosphere. The best choice is yttria, e.g., in the form of yttria coated graphite trays as described in U.S. patent application Ser. No. 08/837,094, filed Apr. 14, 1997, now U.S. Pat. No. 5,993,970 herein incorporated by reference, although zirconia coated trays may also be used.

The invention is additionally illustrated in connection with the following Examples which are to be considered as illustrative of the present invention. It should be understood, however, that the invention is not limited to the specific details of the Examples.

EXAMPLE 1

Figure 2:
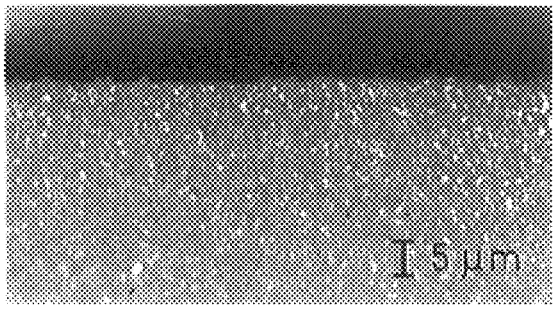
Figure 3:
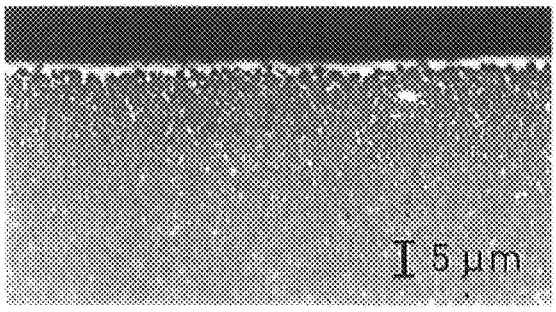
Figure 4:
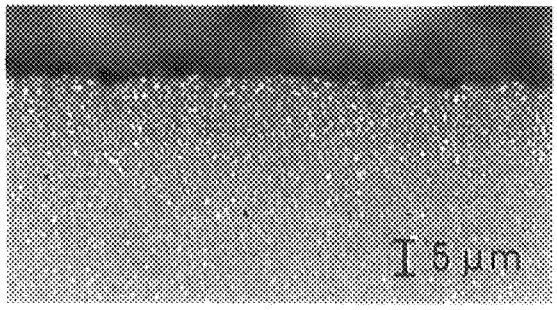

A cermet powder mixture was manufactured from (in weight wt %): 64.5 $Ti(CO_{0.67}\ No_{0.33})$, 18.1 WC and 17.4 Co. The powder mixture was wet milled, dried and pressed into inserts of the type CNMG 120408-PM. In four experiments, inserts were sintered using identical processes except for the CO pressure and sintering time. Cross-sections of the inserts were then prepared using standard metallographic techniques and examined in an optical microscope. FIG. 1 shows an insert sintered for 90 minutes at 1430° C. in a 10 mbar argon atmosphere. Clearly, a continuous thick binder phase layer is obtained on the surface. FIG. 2 shows an insert sintered according to the invention for 90 minutes at 1430° C. in 10 mbar argon and 3 mbar CO. No binder phase is visible on the surface. FIG. 3 shows an insert sintered for 30 minutes at 1430° C. in 10 mbar argon. Again there is a continuous layer of binder phase on the surface. FIG. 4 shows an insert sintered for 30 minutes at 1430° C. in 10 mbar argon and 6 mbar CO. The surface is again free from binder phase.

EXAMPLE 2

Figure 5:
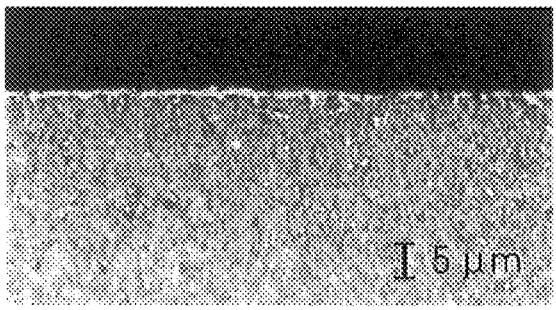
Figure 6:
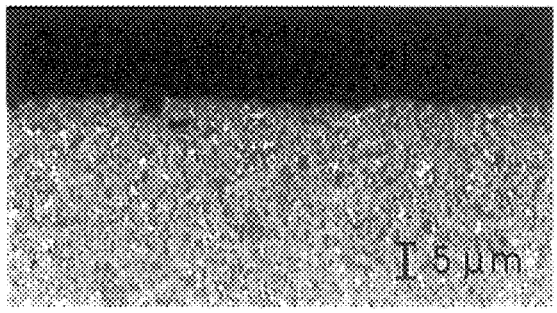

In a different set of experiments, CNMG120408-PM inserts were manufactured from a powder mixture consisting of (in weight- %): 11.0 Co, 5.5 Ni, 26.4 (Ti,Ta)(C,N), 11.6 (Ti,Ta)C, 1.4 TiN, 1.8 NbC, 17.7 WC and 4.6 $Mo_2C$. FIG. 5 shows inserts sintered for 90 minutes at 1430° C. in 10 mbar argon gas. A continuous binder phase layer has formed on the surface. FIG. 6 shows an insert sintered for 90 minutes at 1430° C. in 10 mbar argon and 3 mbar CO. The surface has no binder phase layer.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. In a liquid phase sintering method for producing titanium-based carbonitride alloys containing oxygen only as an impurity in amounts less than 0.3 weight percent, the improvement comprising conducting the liquid phase sintering steps in the presence of a partial pressure of 1–80 mbar of CO gas in the sintering atmosphere.

2. The method of claim 1 wherein the partial pressure of CO gas in the sintering atmosphere is from 1–10 mbar.

3. The method of claim 2 wherein the partial pressure of CO gas in the sintering atmosphere is from 1–5 mbar.

4. The method of claim 1 wherein CO gas is provided from an external source.

5. In the method of claim 1 wherein said partial pressure of CO is obtained by degassing the interior parts of the furnace and said partial pressure of CO is maintained by intermittent pumping to maintain the CO pressure within the desired range.

6. The method of claim 1 wherein the oxygen is present as an impurity in amounts less than 0.2 weight percent.

7. A method for producing titanium-based carbonitride alloys containing oxygen only as an impurity in amounts less than 0.3 weight percent comprising milling powders of the hard constituents and binder phase, pressing the milled powders to form bodies of desired shape and liquid phase sintering the pressed bodies in the presence of a partial pressure of 1–80 mbar of CO gas.

8. The method of claim 7 wherein the partial pressure of CO gas in the sintering atmosphere is from 1–10 mbar.

9. The method of claim 8 wherein the partial pressure of CO gas in the sintering atmosphere is from 1–5 mbar.

10. The method of claim 7 wherein said CO gas is provided from an external source.

11. The method of claim 7 wherein said partial pressure of CO is obtained by degassing the interior parts of the furnace and said partial pressure of CO is maintained by intermittent pumping to maintain the CO pressure within the desired range.

12. The method of claim 8 wherein the oxygen is present as an impurity in amounts less than 0.2 weight percent.

13. A titanium-based carbonitride alloy containing oxygen only as an impurity in amounts less than 0.3 weight percent free from a continuous binder phase surface layer in the as-sintered condition.

* * * * *